US005235917A

United States Patent [19]

Lück et al.

[11] Patent Number: 5,235,917

[45] Date of Patent: Aug. 17, 1993

[54] MONORAIL TROLLEY WITH U-SHAPE FRAME EXTENDING OVER, ABOVE, AND SURROUNDING THE RAIL

[75] Inventors: Jochen Lück, Wetter; Johannes G. Spöler, Borken; Reinhard Siegmund, Dortmund, all of Fed. Rep. of Germany

[73] Assignee: Mannesmann Aktiengesellschaft, Dusseldorf, Fed. Rep. of Germany

[21] Appl. No.: 779,033

[22] Filed: Oct. 18, 1991

[30] Foreign Application Priority Data

Oct. 18, 1990 [DE] Fed. Rep. of Germany ..... 4033373
Jul. 4, 1991 [DE] Fed. Rep. of Germany ..... 4122400
Jul. 4, 1991 [DE] Fed. Rep. of Germany ..... 4122401

[51] Int. Cl.[5] ..... B61B 13/04; E01B 25/08

[52] U.S. Cl. ..... 104/119; 105/32; 105/73; 105/101; 105/144

[58] Field of Search ..... 104/118, 119, 93; 105/30, 32, 73, 101, 141, 144, 150; 474/202, 205

[56] References Cited

U.S. PATENT DOCUMENTS 376,975 1/1888 Adie ..... 474/205 X
3,648,617 3/1972 Metzner et al. ..... 104/119 X
4,207,821 6/1980 Beckert ..... 104/119
4,423,685 1/1984 Kerckhoff ..... 104/119 X
4,531,460 7/1985 Pamer ..... 104/93 X
4,635,839 1/1987 Slavens ..... 105/144 X
4,671,183 6/1987 Fujita et al. ..... 104/118 X
5,092,249 3/1992 Knuettel ..... 105/73 X

FOREIGN PATENT DOCUMENTS 502186 5/1920 France ..... 105/30
70571 3/1990 Japan ..... 104/118
2224148 4/1990 United Kingdom ..... 104/93

*Primary Examiner*—Robert J. Oberleitner
*Assistant Examiner*—S. Joseph Morano
*Attorney, Agent, or Firm*—Cohen, Pontani, Lieberman, Pavane

[57] ABSTRACT

A trolley for traveling along a beam supported from below and having two protruding flanges comprising a frame that partially surrounds the beam, a travel wheel mounted so that it contacts and rolls on an upper surface of the lower flange of the beam, a second wheel mounted within the frame for gliding the trolley along one of the upper surface of the lower flange or a lower surface of the upper flange and a guide roller mounted within the frame for guiding the trolley along the beam.

13 Claims, 7 Drawing Sheets

MONORAIL TROLLEY WITH U-SHAPE FRAME EXTENDING OVER, ABOVE, AND SURROUNDING THE RAIL

FIELD OF THE INVENTION

The present invention relates to a trolley for transporting workpieces in a manufacturing plant horizontally or along an incline. The trolley travels by at least one wheel on a protruding lower flange of a beam.

BACKGROUND OF THE INVENTION

Trolleys which transport loads or workpieces in manufacturing plants and which travel on the lower flange of a beam are disclosed in Federal Republic of Germany Patent document OS 36 27 358. The trolleys therein disclosed are suspension trolleys for crane systems which lift a workpiece and transport it suspended to a work station. Thereafter, the workpiece is lifted again and deposited at another work station. Since this procedure is not always optimal for assembly line manufacture, roller tables are frequently more suitable because their width can be selected to correspond to that of the workpiece being transported.

SUMMARY OF THE INVENTION

The present invention discloses a highly stable trolley that can transport workpieces through a manufacturing plant at work height even if the workpieces are much wider than the trolley or unevenly loaded on the trolley. In a preferred embodiment, the trolley has an inverted U shape that fits upon, partially surrounds, and slides along the top of a supporting beam. The beam, in turn, is supported from below by mounting it to the floor or any other suitable structure. The beam is preferably either an I-beam with upper and lower protruding flanges. On one of its sides, the trolley has at least one travel wheel which rides on the upper surface of the lower flange of the beam and an opposite roller which is positioned at or in close proximity to the lower surface of the upper flange of the beam. The travel wheel and opposite roller acting in conjunction prevent the trolley from tilting in a direction longitudinal and parallel to the beam. In a preferred embodiment, there are two travel wheels which cooperate with one another by gears. The opposite roller may optionally roll along and contact the lower surface of the upper flange of the beam. On the opposite side of the trolley, there are elements for receiving electrical power and control signals which are transmitted along the beam through an electrical conduit that is mounted along the web of the beam.

The trolley preferably also has guide rollers which roll along or are in close proximity to the side surfaces of the upper and lower flanges of the beam. Preferably, the trolley has four pairs of such guide rollers that are positioned at the front and rear of the trolley and at the top and bottom of the trolley so that they engage the upper and lower flanges of the beam. The guide rollers ensure that the trolley travels securely along the beam to eliminate the possibility that the trolley will tilt in a direction perpendicular to the beam, even if the trolley is loaded unevenly such as when the center of gravity of the load being transported by the trolley is not centered precisely above the beam. In such an uneven loading situation, the load need only be clamped to the trolley by a means such as a screw clamp.

The beam is preferably supported from below by a groove block or a nut and bolt combination which fits into at least one insertion groove in the bottom of the lower flange of the beam. The insertion groove may also be used to fasten target markings used in the control of the trolley.

The trolley preferably has support plates on its vertical sides where a gear drive motor or a box containing control electronics may be mounted, preferably on either side of the trolley. The gear drive motor and control box are electrically connected to one another using electric lines which pass through and are physically protected by C-shaped or U-shaped transverse beams which partially form the structure of the trolley. The support plates onto which the gear drive motor and control box are mounted are preferably detachably fastened, such as by bolts, to the trolley frame to enable the trolley to be easily mounted on to or dismounted from the beam.

Another advantage of the present invention is that the trolley can be connected in series to other trolleys and yet still be able to travel over vertical and horizontal curves in the beam. This freedom of movement is accomplished by using a turntable that is rotatably mounted in the top surface of the trolley. A pin is used to rotatably connect a cross member to the turntable. The cross member connects one trolley in series to another. The turntable assemblies on successive trolleys permit the trolleys to travel along horizontal curves of the beam without significant difficulty, while the pin connections similarly enable the trolleys to easily negotiate vertical curves in the beam. As a result, the trolleys can be used with curved beams to transport workpieces to different locations on the same floor in a manufacturing plant, to different floors, or at different heights on the same floor to avoid other manufacturing activities.

When two trolleys are used in conjunction and interconnected by a cross member, only one trolley needs to be driven by a controllable gear drive motor. In this embodiment, the travel wheels of both the driven and the non-driven, free rolling trolley are preferably on the same side of the web of the beam so that the basic elements of the two trolleys are substantially identical.

Where two trolleys are connected to one another in series, a directional turntable can be used when both trolleys are driven. In this use, the pair of trolleys roll on-to a turntable, are turned simultaneously by the turntable, and continue travelling in a different direction along a different beam.

In another embodiment, where the beam has a steep and long horizontal incline, the opposite roller that runs along or in proximity to the lower surface of the upper flange of the beam is driven by the travel wheel, preferably by a double toothed belt which engages teeth in a gear connected to and driving the travel wheel and other teeth in another gear connected to and driving the opposite roller. Thus, either the travel wheel or the opposite roller provides a forward driving force should the workpiece being transported cause the trolley to shift slightly.

This particular type of drive mechanism also prevents the transfer of dirt from the lower flange or travel wheel to the upper flange or support roller.

In this particular embodiment where the trolley is intended to travel along inclined beams, there is also preferably an air gap between the opposite roller and the lower surface of the upper flange of the beam. When the beam begins an incline, a filling support is affixed to the lower surface of the upper flange of the beam. When the trolley of this embodiment is travelling up an inclined beam, the filling support acting upon the opposite roller increases the contact pressure of the travel wheel and support wheel on the lower flange of the beam. Additionally, the presence of the filling support allows the driven opposite roller to contribute a driving force to the trolley.

In a further embodiment of the present invention, four trolleys may be used as support for a work platform with two trolleys running in series on one beam and the other two trolleys running in series on another parallel beam. More trolleys may be associated in such a way to provide support for larger platforms thereby producing a highly economical and diversified transport mechanism.

In a further embodiment of the present invention, slight variances in the distance between two parallel beams may be compensated by providing that the work platform be eccentrically mounted on a turntable assembly mounted to the top of the trolley. Preferably, this eccentric turntable mounting is used with free running trolleys.

In addition to using a platform supported on trolleys to move workpieces, the platform may also be used with equipment such as cranes.

BRIEF DESCRIPTION OF THE DRAWINGS

These and other objects, features, elements, and advantages of the invention will be more readily apparent from the following description of the invention, in which.

DETAILED DESCRIPTION OF THE PRESENTLY PREFERRED EMBODIMENTS

Figure 1:
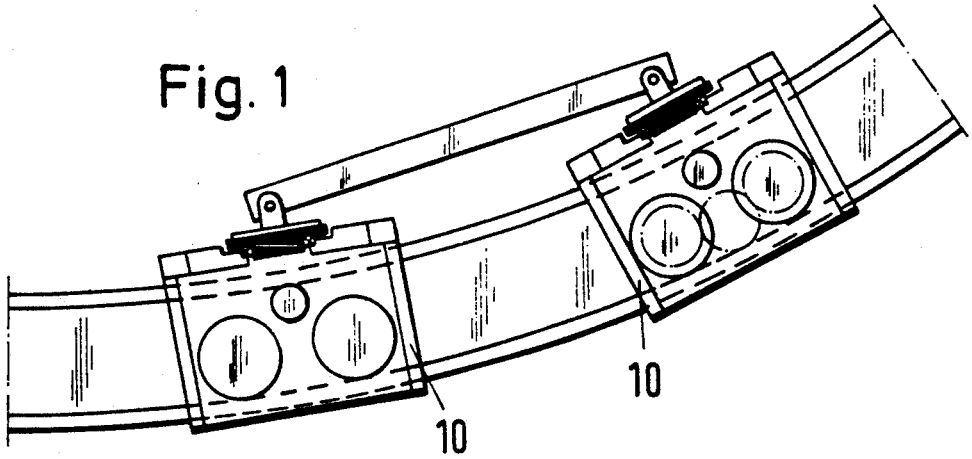
FIG. 1 is a side view of the trolley of the present invention showing two trolleys in series on a vertically curved beam.
Figure 2:
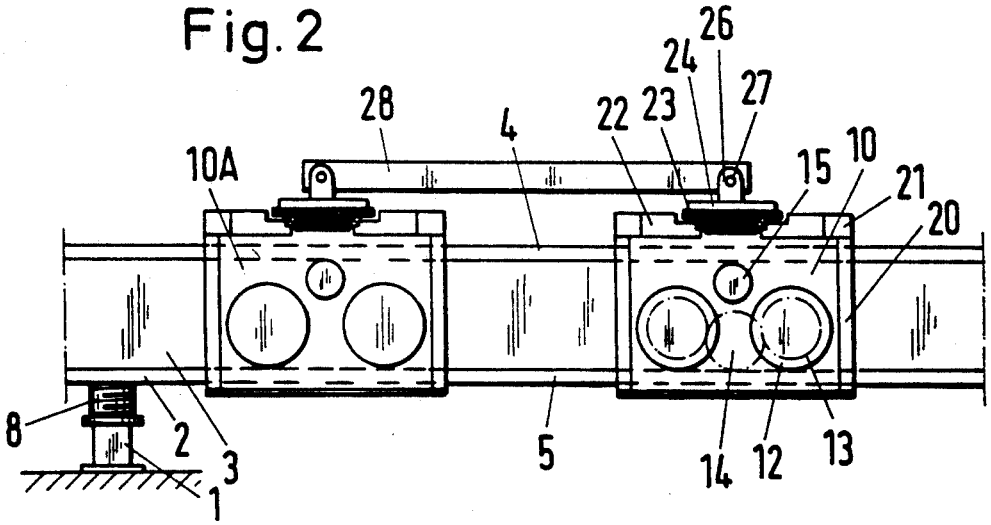
FIG. 2 is a side view of the trolley of the present invention showing two trolleys in series on a horizontal beam.
Figure 3:
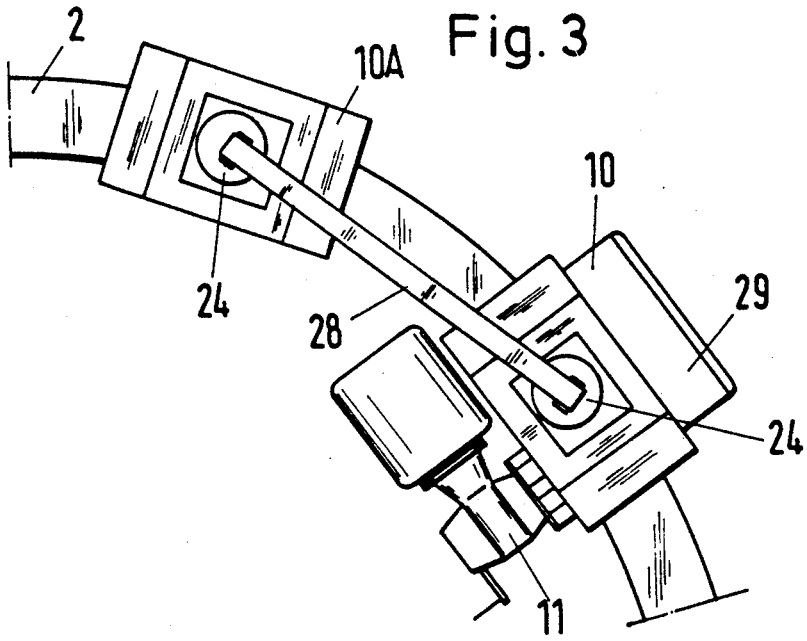
FIG. 3 is a top view of the trolley of the present invention showing two trolleys in series on a horizontally curved beam.
Figure 4:
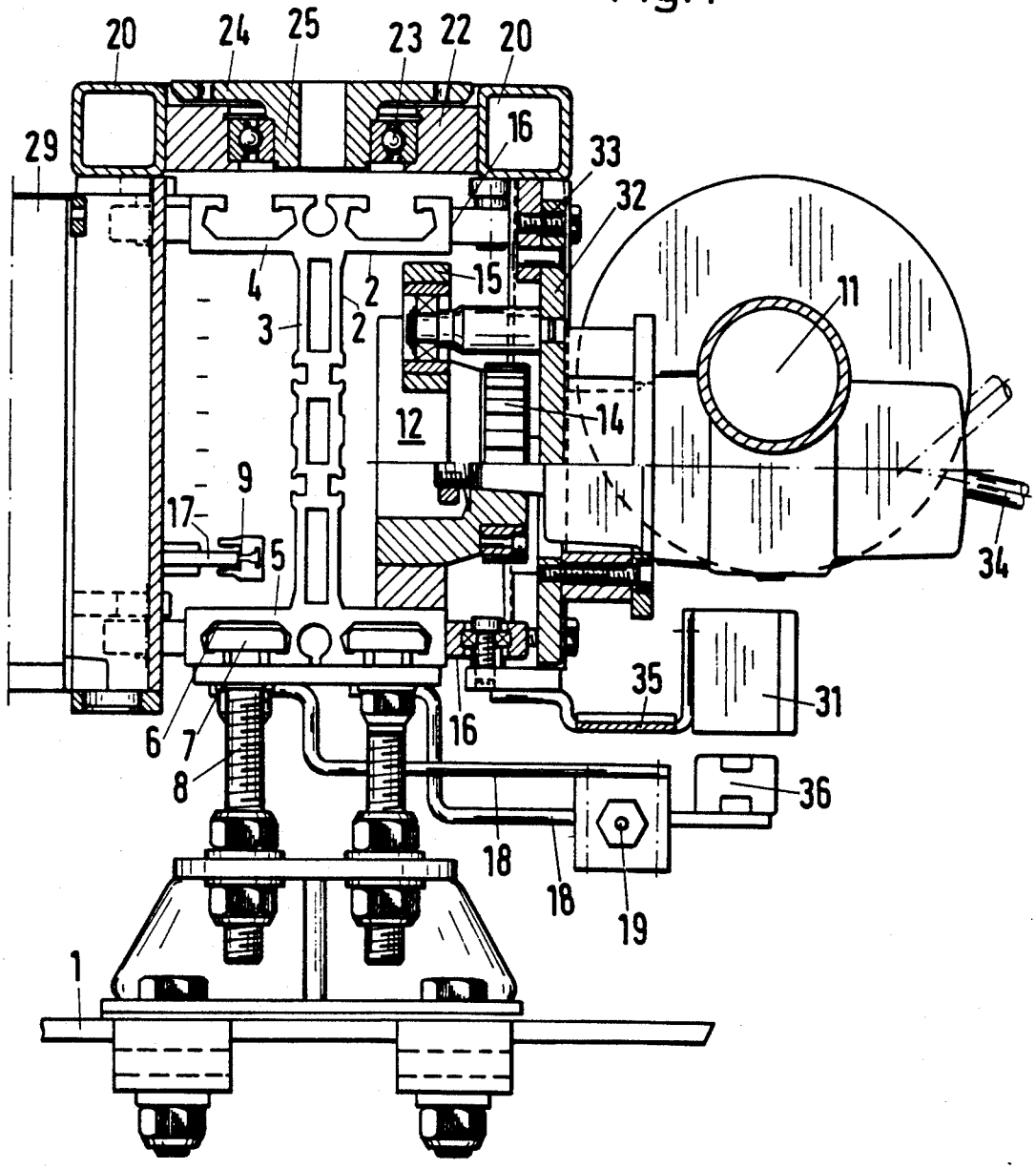
FIG. 4 is a sectional view of the trolley of the present invention.

FIGS. 1-3 show two trolleys 10 in series on I-beam 2 which is bolted by bolts 8 to support 1. Beam 2 is preferably either an I-beam with upper and lower protruding flanges or a box beam with protruding upper and lower flanges so that it appears, in cross section, like an I-beam with a thick, vertical web section. Other types of beams may be used provided that they possess upper and lower protruding flanges. Both trolleys travel on the lower flange 5 of beam 2 on two travel wheels 12. In FIG. 2, the right trolley 10 is driven while the left trolley 10A is not driven, or free rolling. Travel wheels 12 of trolley 10 have gear rims 13 and cooperate with one another through gear wheel 14. One of the two gear rims 13 of travel wheels 12 is driven by gear drive motor 11, as shown in FIGS. 3 and 4. Each trolley 10 has an opposite roller 15 which rolls below and adjacent to the lower surface of upper flange 4 of beam 2. Cross beam 21 of trolley 10 passes above upper flange 4 to connect to the side of trolley 10 opposite to that on which travel wheels 12 are mounted. The top of trolley 10 has a receiving plate 22 which has a circular hole at its center into which bearing 23 and turntable 24 are mounted. Bearing 23 allows turntable 24 to rotate within the hole of receiving plate 22. Bearing lug 26 is mounted at the center of turntable 24 and has a hole through which pin 27 passes. Pin 27 rotatably connects bearing lug 26 to cross member 28 which connects driven trolley 10 to free rolling trolley 10A.

As shown in FIG. 4, travel wheels 12 and opposite roller 15 are present only on one side of beam web 3 of beam 2. On the opposite side of beam web 3 are mounted a plurality of conduit gliders 9, only one of which is shown in FIG. 4. Glider contacts 17 are electrically connected to control box 29 which controls the operation of gear drive motor 11. Glider contacts 17 slide along and electrically connect to conduit gliders 9 to tap an electrical signal transmitted along conduit glider 9. This electrical signal operates and controls gear drive motor 11. This particular configuration of providing electrical power and control signals to trolley 10 does not interfere with the movement of trolley 10 along beam 2.

Referring to FIG. 4, I-beam 2 is entirely symmetrical and has longitudinal grooves 6 in the upper surface of upper flange 4 and the lower surface of lower flange 5. Longitudinal grooves 6 exist along the length of beam 2 and can exist as single long grooves or short segments of grooves. Groove blocks 7 connected to bolts 8 fit snugly into the lower grooves 6 of I-beam 2. Bolts 8 thus fasten I-beam 2 to support 1. The lower grooves 6 may optionally also be used to support holders 18 for target markers 19. When one of these target markers 19 coincides with a switch tab 35 mounted to trolley 10, a control pulse can be produced to control gear drive motor 11, for example, to turn gear motor 11 on or off. Another holder 18 mounted to I-beam 2 may also optionally hold magnet 36 to actuate magnetic notch switch 31 optionally mounted to driven trolley 10.

The dependable guidance of trolley 10 along I-beam 2 is assured by guide rollers 16 which roll along or adjacent to the side edges of upper flange 4 and lower flange 5 of I-beam 2. Referring to FIG. 4, receiving plate 22 is mounted to trolley 10 between two frames 20. Bearing 23 fits into the center hole in receiving plate 22. Plug 25 is rotatably mounted within bearing 23, and turntable 24 is connected to plug 25.

Figure 5:
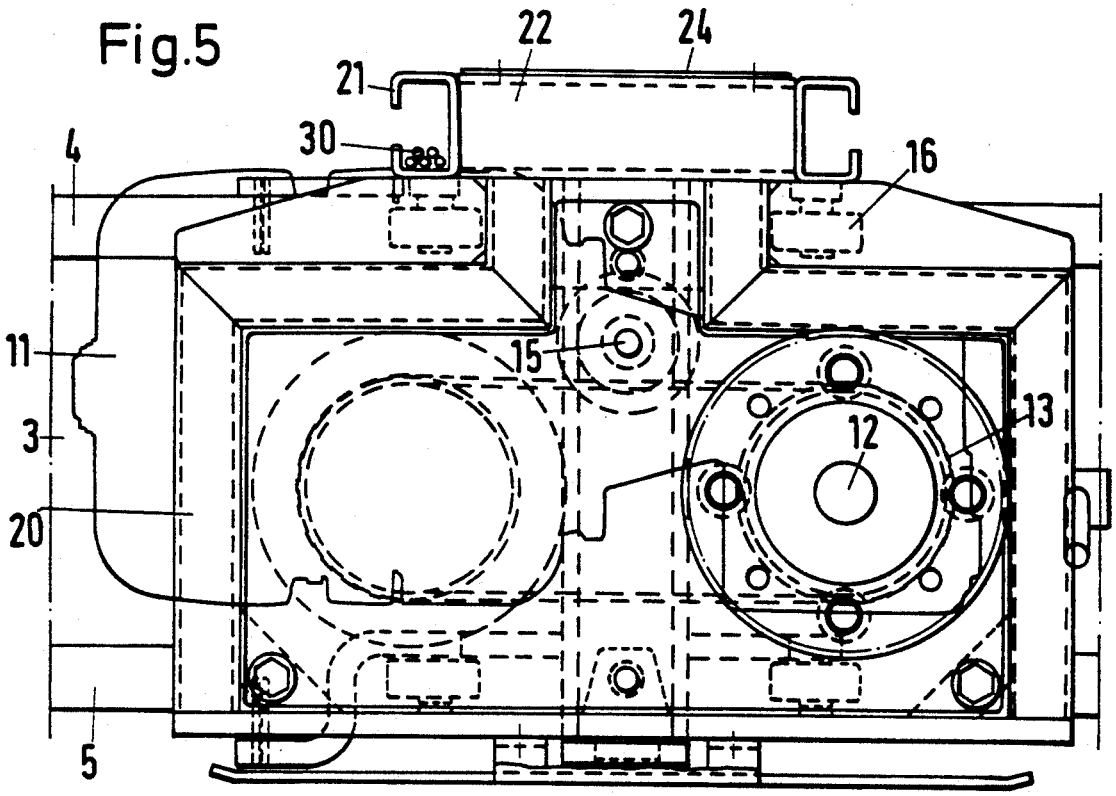
FIG. 5 is a side view of the trolley of the present invention of FIG. 4.
Figure 6:
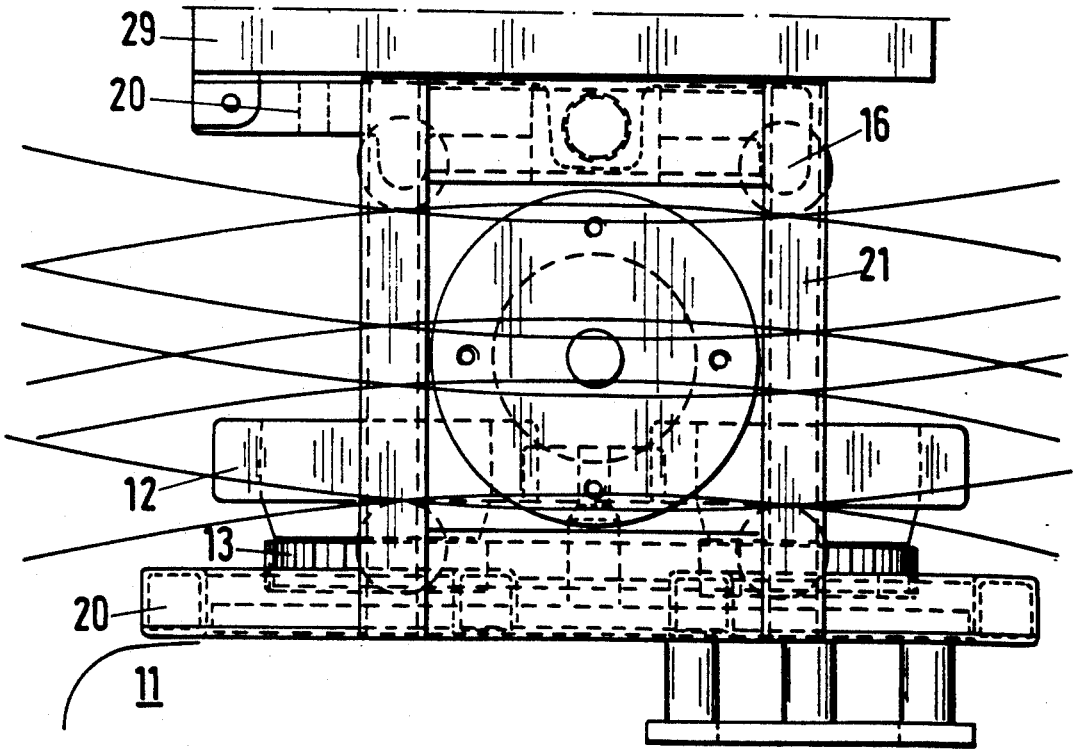
FIG. 6 is a top view of the trolley of the present invention.

Referring to FIGS. 5 and 6, the two frames 20 are connected to one another by C-shaped cross beams 21. Electric lines 30 connecting control box 29 to gear drive motor 11 pass through the hollow center portion of cross beams 21. The drive of gear drive motor 11 can be disengaged from the driven travel wheel 12 by a clutch (not shown) which can be actuated by hand lever 34.

Figure 7:
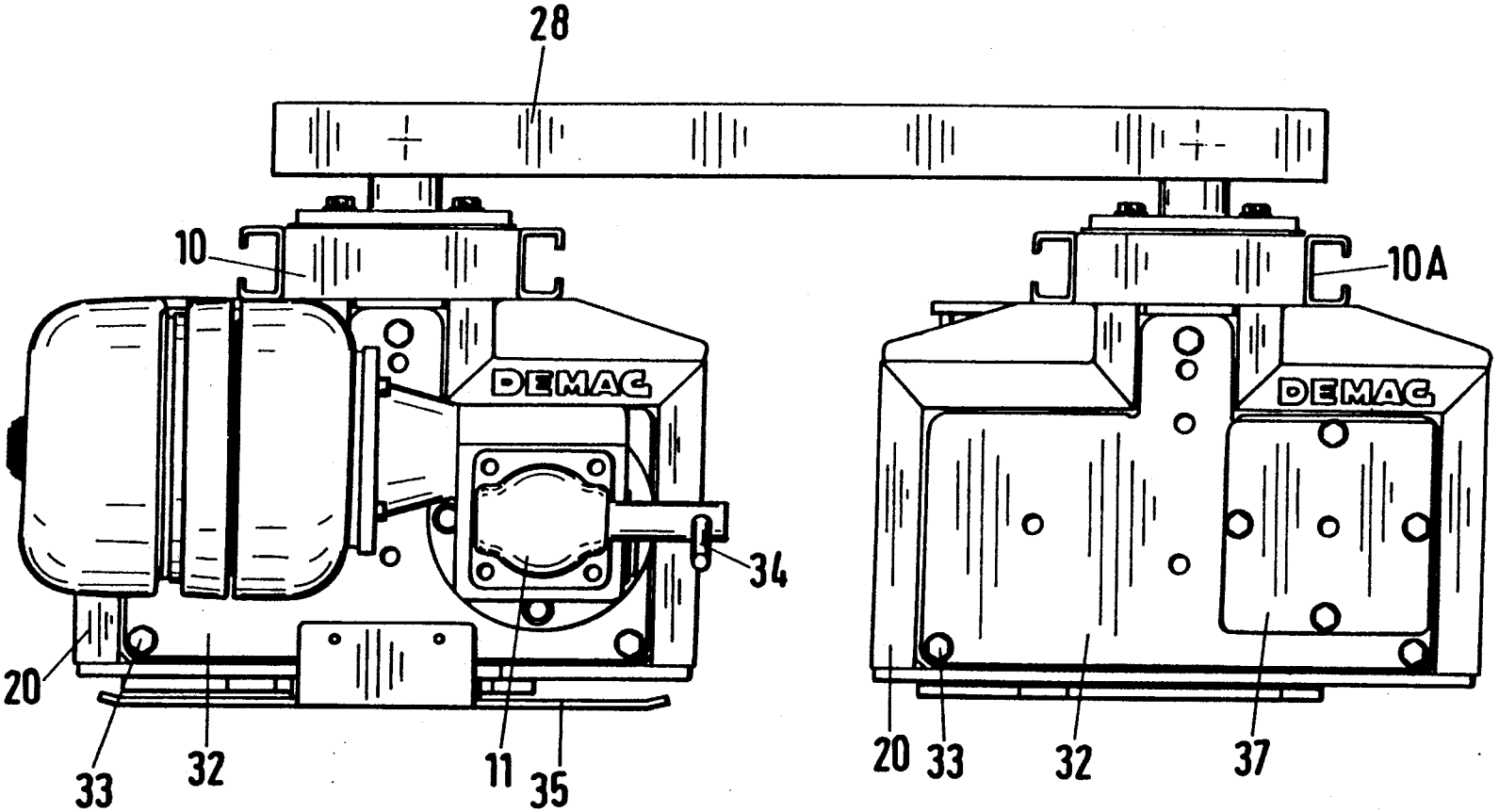
FIG. 7 is an enlarged side view of the trolley of the present invention showing two trolleys connected in series to one other.

FIG. 7 shows a driven trolley 10 connected in series by cross member 28 to a non-driven, free rolling trolley 10A. Both trolleys have a frame 20 to which are attached support plates 32 by means of bolts 33. Support plates 32 may be temporarily removed by removing bolts 33 so that trolleys 10, 10A can be easily mounted onto beam 2. Gear drive motor 11 with hand lever 34 for a clutch (not shown) is attached to support plate 32 of the driven trolley 10. In free rolling trolley 10A, the opening for the gear motor is covered by cover plate 37.

Figure 8:
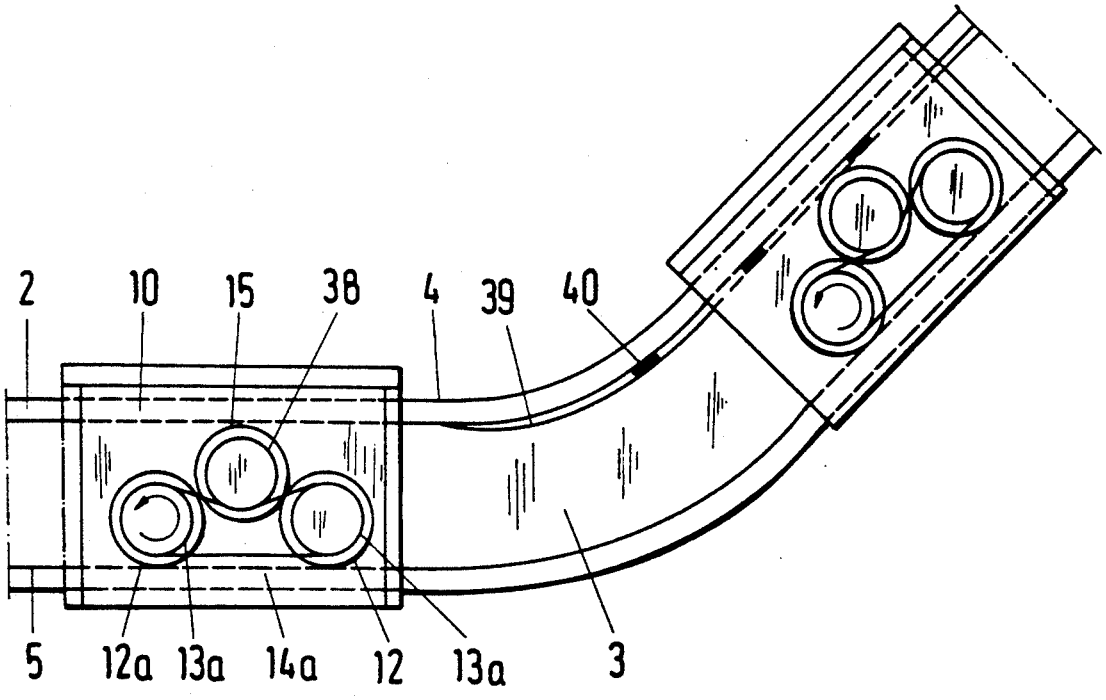
FIG. 8 is a side view of an alternate embodiment of the trolley of the present invention showing two trolleys in series on a steeply inclined beam.

In the alternative embodiment shown in FIG. 8, I-beam 2 has a steep horizontal incline. The trolleys 10 travel on the lower flange 5 of the I-beam 2 via driven travel wheel 12 and support wheel 12*a*. These wheels are provided with gear rims 13*a* and drive one another using double-toothed belt 14*a*. The outer teeth of double-toothed belt 14*a* are tangent to and engage mating gear wheel 38 of opposite roller 15 which is mounted on trolley 10 so that it is below and adjacent to the lower surface of upper flange 4 so that there is an air gap between the lower surface of upper flange 4 and opposite roller 15. Preferably, the size of the gear rims 13*a* on the travel wheel 12 and support wheel 12*a* and the size of the mating gear wheel 38 on opposite roller 15 are selected so that double-toothed belt 14*a* engages mating gear wheel 38 at an angle of about 30° as shown in FIG. 8. This wrap angle helps to prevent toothed belt 38 from disengaging from the teeth of the gear wheels. When I-beam 2 begins an incline, upper flange 4 is preferably thickened on its lower surface by filler support 39 so that the air gap is filled in and opposite roller 15 contacts the lower surface of upper flange 4 of I-beam 2. Filler support 39 preferably has a rough surface and is resilient in nature. Illustratively, filler support 39 is comprised of an elastic material of a thickness of about 5 mm to about 10 mm. Alternatively, as shown in FIG. 8, filler support 39 may be comprised of a thin strip of sheet metal that is supported by a plurality of spring elements 40 attached the lower surface of upper flange 4. As in the previously described embodiments, travel wheel 12 is driven by a gear drive motor (not shown). When trolley 10 is travelling over a level horizontal path, opposite roller 15 does not contact filling support 39 and can turn freely, so that there is no wear and little resistance to travel.

Figure 9:
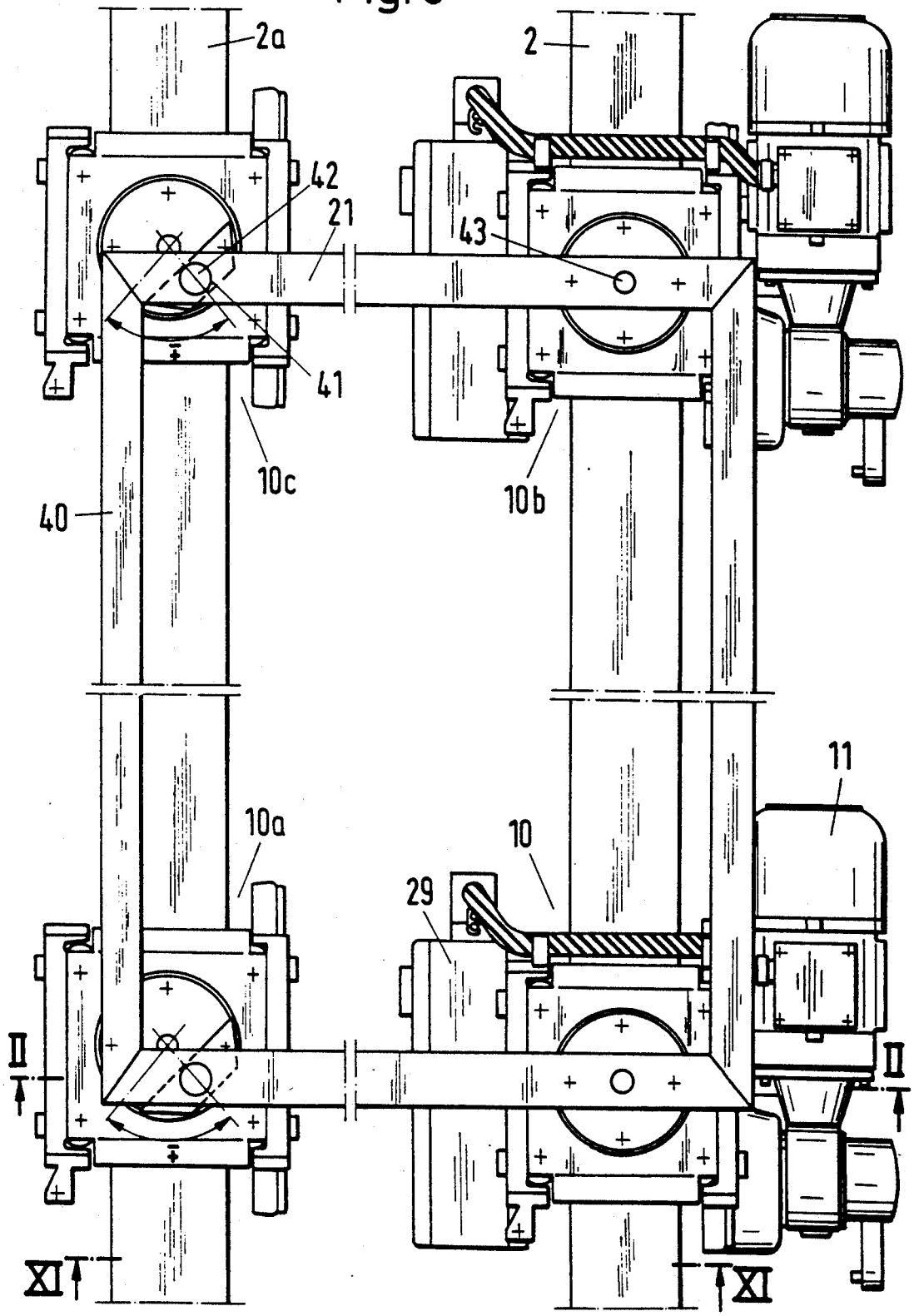
FIG. 9 is a top view of an alternate embodiment of the trolley of the present invention showing two pairs of two trolleys on two parallel beams.
Figure 10:
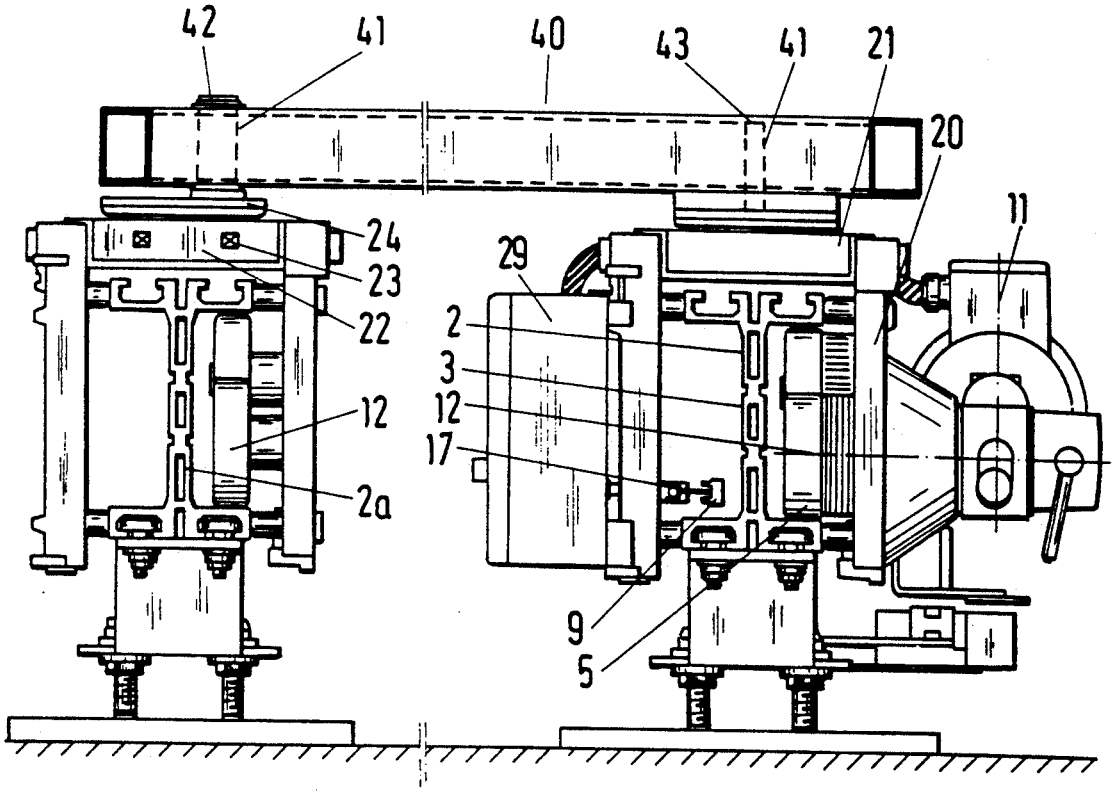
FIG. 10 is a partial sectional and side view of the embodiment shown in FIG. 9.

Referring to the embodiment shown in FIGS. 9 and 10, a platform 44 is formed by connecting four trolleys that ride on two parallel I-beams. Platform 44 is comprised of driven trolleys 10 and 10*b* which travel in series on right I-beam 2 and two free rolling trolleys which travel in series on left I-beam 2*a*. Conduit gliders 9 (not shown) are mounted on right I-beam 2 to engage glider contacts 17 (not shown) on driven trolleys 10 and 10*b*. Electrical lines (not shown) extend from glider contacts 17 through control box 29 to gear drive motors 11 of trolleys 10 and 10*b*. Driven travel wheels 12 of trolleys 10 and 10*b* travel along the lower flange 5 of I-beam 2 while non-driven travel wheels 12 of trolleys 10*a* and 10*c* travel along the lower flange 5 of I-beams 2*a*.

Driven trolleys 10 and 10*b*, as well as free rolling trolleys 10*a* and 10*c*, each have a receiving plate 22 with a bearing 23 for a turntable 24. The turntables 24 of driven trolleys 10 and 10*b* each have in their center a pin 43 which extends in each case into a hole 41 in the platform 44.

The left free rolling trolleys 10*a* and 10*c* have eccentric pins 42 that are positioned off-center on turntables 24. Eccentric pins 42 extend into holes 41 in the platform 44. As can be seen in FIGS. 9 and 10, eccentric pins 42 in free rolling trolleys 10*a* and 10*b* may be swung to the right out of the zero position, when the separation between the I-beams 2 and 2*a* is not exactly uniform. The distance of eccentric pins 42 from the axis of rotation of turntables 24 must be greater that the maximum expected distance of deviation between parallel beams 2 and 2*a* to ensure proper and effective operation of the eccentric mounting assembly. As a result, this assembly gives the trolley platform some play so that the separation between I-beams 2 and 2*a* need not be especially uniform.

Although FIG. 9 shows that trolleys 10 and 10*b* which ride on the same beam are both driven, only one need be driven. Alternatively, trolleys 10 and 10*a* which ride on different beam may be the only ones driven. However, it is preferably for only trolleys riding on the same beam be driven to simplify the control of the platform's movement, to reduce the likelihood of jamming, and to simplify the provision of electrical power and control signals to the platform along only a single I-beam.

It has also been determined that when using trolleys on parallel beams connected to a platform as shown in FIG. 9 jamming of the trolley may be minimized if the separation between trolleys in series on a single beam, i.e., the distance between trolleys 10 and 10*a*, is greater than the separation between the two parallel beams, i.e., the distance between beams 2 and 2*a*.

While the invention has been described in conjunction with specific embodiments, it is evident that numerous alternatives, modifications, and variations will be apparent to those skilled in the art in light of the foregoing description. For example, although the trolley of the present invention has been described as having four pairs of guide rollers 16 on each trolley with one guide roller of each pair on one side of a flange and the other corresponding guide roller of the pair on the other side of that flange, fewer or more pairs of guide rollers may be used on each trolley. Also, guide rollers need not be used in pairs. Illustratively, only one guide roller is used which rolls along or is in close proximity to a single side surface of a flange of the beam. Similarly, two guide rollers 16 may be used that roll along or are in close proximity to a single side surface of the same flange of the beam or alternatively different flanges on the same side of the beam. Additionally, when more than one trolley is used to create a support for a platform, guide rollers may be used only adjacent to the outside side surfaces of one or more flanges.

Additionally, travel wheel 12, support wheel 12*a*, and opposite roller 15 may be present on both sides of the trolley so that they roll on both sides of the flange instead of only one side of the flange as described above.

What is claimed is:

1. A trolley system comprising at least one trolley for traveling along a beam supported from below and having first and second sides and upper and lower flanges protruding from both sides of said beam comprising:

a said trolley comprising a substantially U-shaped frame extending from above over and surrounding said beam;

the trolley having on the first side of the beam a driving means mounted on the frame and a first and a second travel wheel arranged one behind the other in a travel direction of the trolley and mounted within said frame for contacting and rolling on an upper surface of said lower flange on the first side of said beam;

the trolley having on the second side of said beam current supply and controlling means including glider contacts mounted so as to be in sliding contact with contact gliders mounted on said beam; and the trolley further comprising at least a front guide roller and a rear guide roller as well as an upper guide roller and a lower guide roller, said guide rollers being mounted within said frame for guiding said trolley along said beam.

2. The trolley system of claim 1, wherein said travel wheel comprises means for driving said second travel wheel.

3. The trolley system of claim 2, wherein said first travel wheel and said second travel wheel comprise gear rims that cooperate with one another through a gear wheel.

4. The trolley system of claim 1, comprising an opposite wheel mounted on the first side below a lower surface of said upper flange of said beam.

5. The trolley system of claim 1, wherein said frame comprises a vertical frame portion each on the first and second sides of said beam; a transverse beam for connecting said vertical frame portions; and a support plate on each of said vertical frame portions for holding said driving means and said controlling means.

6. The trolley system of claim 5, wherein at least one of said support plates is mounted to said frame by means of screws.

7. The trolley system of claim 5, wherein said transverse beam is one of C-shaped and U-shaped.

8. The trolley system of claim 5, further comprising a receiving plate on top of said frame and a turntable rotatably mounted on said plate.

9. The trolley system of claim 8, additionally comprising a bearing disposed in said receiving plate and a plug extending from said turntable into said bearing for mounting said turntable on said plate.

10. The trolley system of claim 8, wherein said receiving plate is disposed between said vertical frame portions.

11. The trolley system of claim 8, additionally comprising a second trolley; and means on said turntable for connecting said trolley with said second trolley; said connecting means comprising a cross-member connecting said two trolleys, a bearing lug mounted on said turntable and a pin for connecting said cross-member to said bearing lug.

12. The trolley system according to claim 1, wherein said trolley comprises two upper guide rollers and two lower guide rollers.

13. The trolley system according to claim 1, wherein the upper and lower flanges have side edges, said guide rollers being mounted so as to roll on said side edges of the flanges.

* * * * *